United States Patent [19]

Polk

[11] Patent Number: 4,497,064

[45] Date of Patent: Jan. 29, 1985

[54] METHOD AND APPARATUS FOR REPRODUCING SOUND HAVING AN EXPANDED ACOUSTIC IMAGE

[75] Inventor: Matthew S. Polk, Baltimore, Md.

[73] Assignee: Polk Audio, Inc., Baltimore, Md.

[21] Appl. No.: 405,341

[22] Filed: Aug. 5, 1982

[51] Int. Cl.[3] ..... H04R 5/00

[52] U.S. Cl. ..... 381/24; 381/111

[58] Field of Search ..... 181/144, 145; 381/1, 381/2, 10–12, 17, 18, 24, 111, 117, 87–90

[56] References Cited

U.S. PATENT DOCUMENTS

| | | | |
|---|---|---|---|
| 3,104,729 | 9/1963 | Olson | 181/145 |
| 3,697,692 | 10/1972 | Hafler | 381/18 |
| 4,058,675 | 11/1977 | Kobayashi et al. | 381/24 |
| 4,199,658 | 4/1980 | Iwahara | 381/24 |

FOREIGN PATENT DOCUMENTS

| | | | |
|---|---|---|---|
| 52-21802 | 2/1977 | Japan | 381/24 |
| 54-118802 | 9/1979 | Japan | 381/24 |
| 1604766 | 12/1981 | United Kingdom | 381/24 |

*Primary Examiner*—Gene Z. Rubinson
*Assistant Examiner*—W. J. Brady
*Attorney, Agent, or Firm*—Cushman, Darby & Cushman

[57] ABSTRACT

Apparatus for reproducing sound having an expanded acoustic image is used in a stereophonic sound reproduction system having a left channel output and a right channel output, which need not be binaural. A right main speaker and a left main speaker are disposed at right and left main speaker locations, respectively, which are equidistantly spaced from a listening location along a listening axis perpendicular to a line joining the left and right main speakers. The interaural time delay between the ears of a listener at the listening location with respect to the main speakers is Δt. A first right sub-speaker and a first left sub-speaker are respectively disposed at right and left sub-speaker locations equidistantly spaced from the listening location, and spaced such that sound from the sub-speakers as perceived by the ears of a listener is delayed as compared to sound from the main speakers by Δt. The left and right channel outputs are coupled to the left and right main speakers, respectively. Inverted left and right channel outputs are coupled to the first right and first left sub-speakers, respectively. Additional sub-speakers can be provided for each channel and fed the same signals as the first sub-speakers. Alternatively, a second right sub-speaker and a second left sub-speaker can be fed other signals, such as the left and right channel outputs, respectively. In one embodiment, the main and sub-speakers for each channel are respectively incorporated in a common enclosure to fix the spacing therebetween.

23 Claims, 16 Drawing Figures

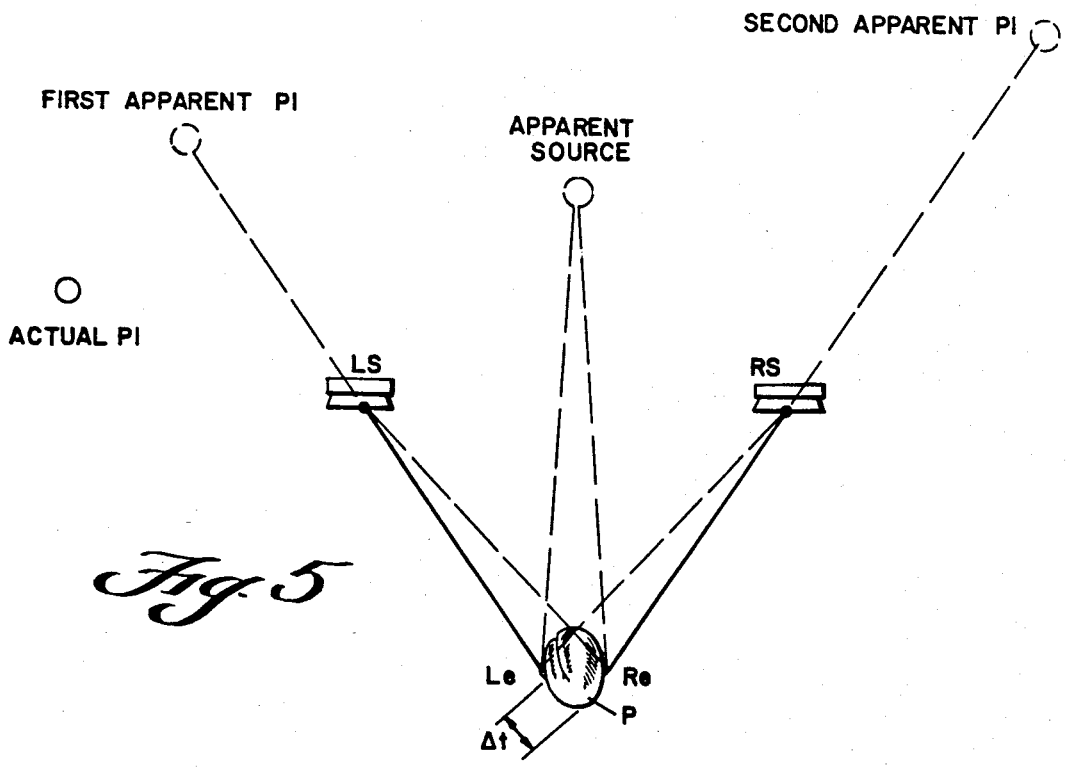
Fig. 5
Fig. 6
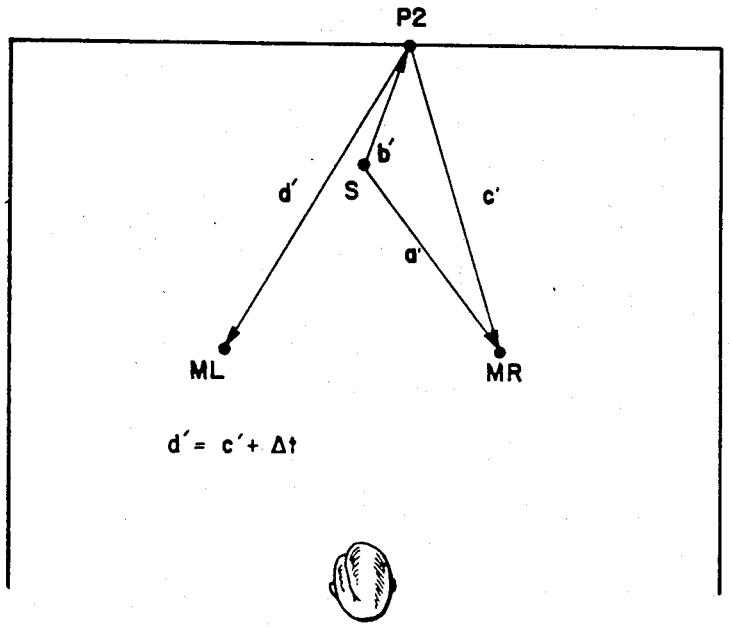

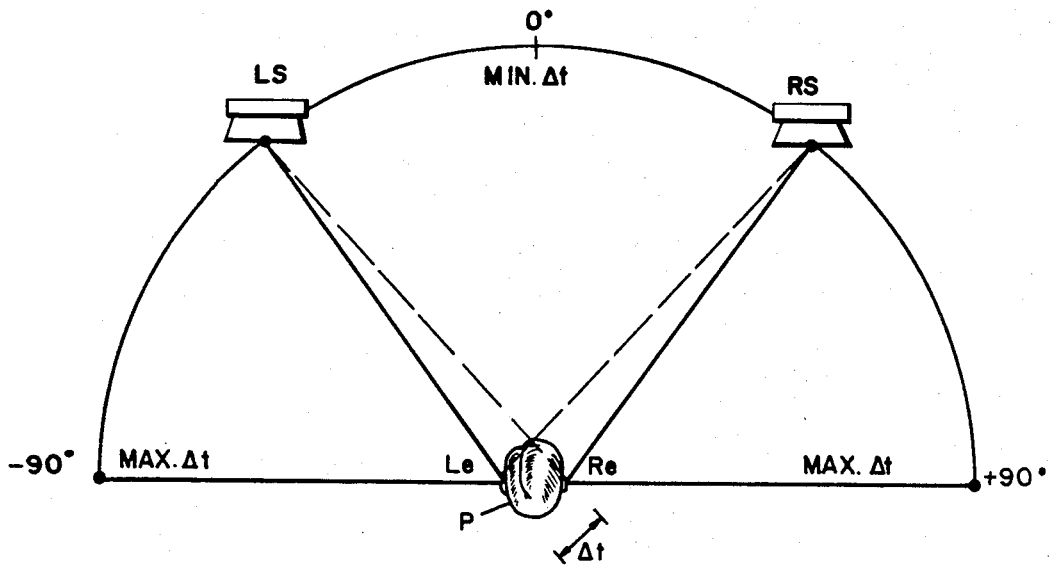
Fig. 7
Fig. 9
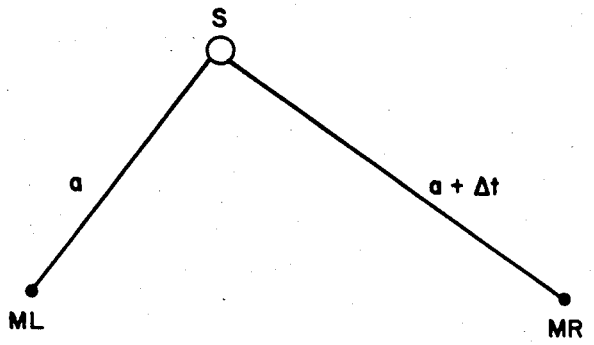
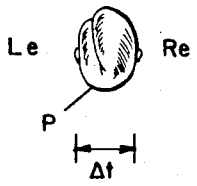

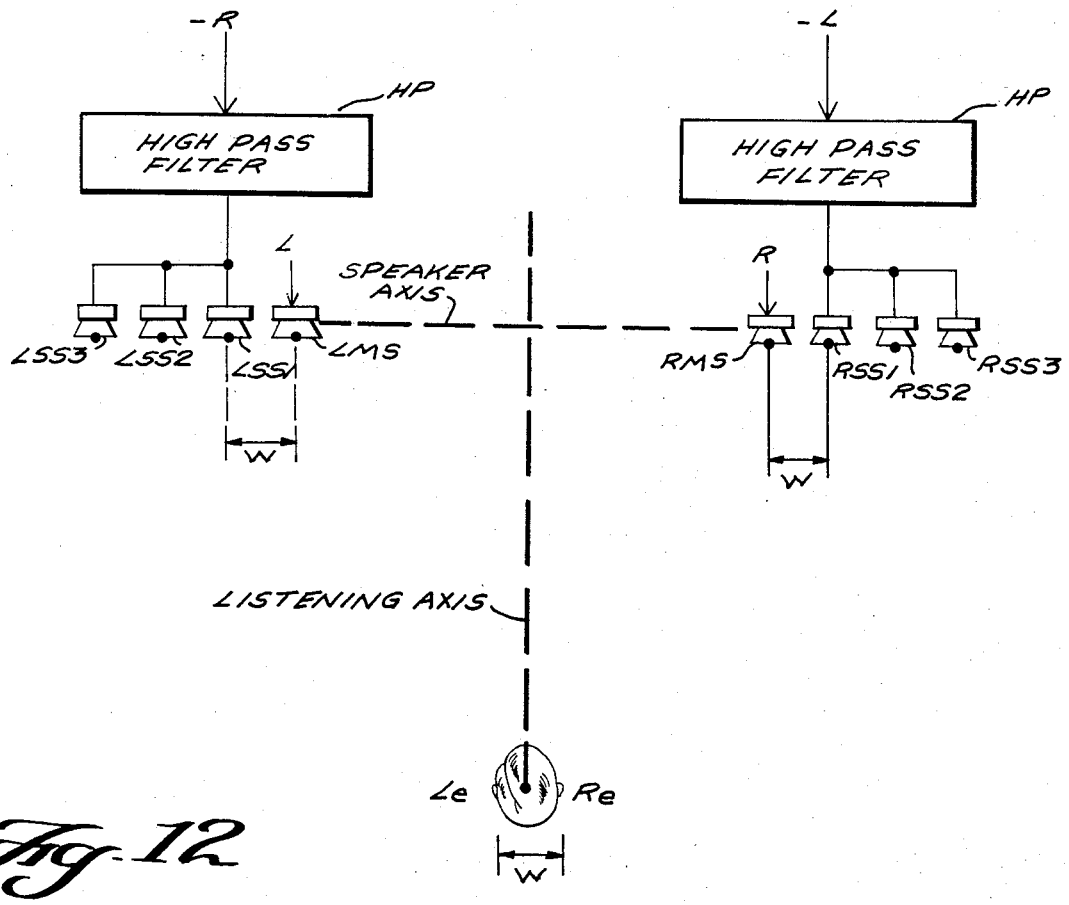
Fig. 12
Fig. 13
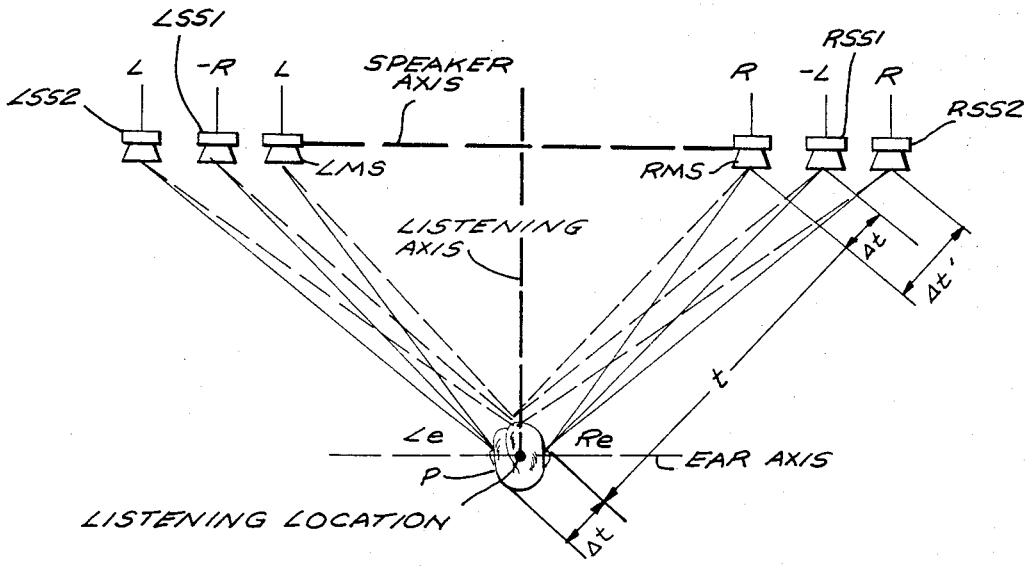

METHOD AND APPARATUS FOR REPRODUCING SOUND HAVING AN EXPANDED ACOUSTIC IMAGE

CROSS REFERENCES TO RELATED APPLICATIONS

This application is related to application Ser. No. 383,151, filed May 28, 1982.

BACKGROUND OF THE INVENTION

This invention pertains to a method and apparatus for reproducing sound from stereophonic source signals in which the reproduced sound has a greatly expanded acoustic image.

The present invention can best be understood and appreciated by setting forth a generalized discussion of the manner in which stereophonic signals originate, as well as a generalized discussion of the manner in which sound is conventionally reproduced from a stereophonic signal source.

When live music is, for example, performed the listener perceives the sounds of the instruments and performers as coming from the general direction of each instrument or performer. The sonic qualities of the acoustic environment in which the music is performed are also perceived as surrounding the listener. Conventional stereophonic recording and reproducing techniques limit the sound field to an area between two speakers thereby losing much of the stereo information.

The human auditory system localizes position through two mechanisms. Direction is perceived due to an interaural time delay or phase shift. Distance is perceived due to the time delay between an initial sound and a similar reflected sound. A third, poorly understood mechanism, causes the ear to perceive only the first of two similar sounds when separated by a very short delay. This is called the precedence effect. Through these mechanisms the listener perceives the direct sound reflected from the walls of the hall as a multitude of secondary sounds arriving from different directions and distances.

Referring to FIG. 1, there is schematically illustrated a listener P situated in a room having walls W1, W2, W3 and W4, and containing a sound source S. In addition to the direct sound path DP from source S to the listener, there are a multitude of reflected sound paths, and exemplary reflected paths are shown in FIG. 1 as RP1 through RP6. The floor and ceiling reflections are not shown for the sake of clarity, but reflected sounds arrive at the listener's ears from nearly every direction.

Being immersed in this reverberent field, the listener will perceive the direct sound from the Source, S, and will also form a subliminal impression of the size and shape of the hall where the performance is taking place based on the arrivals of the reflected sounds. Turning now to FIG. 2, there is schematically illustrated the process of normal stereophonic recording. A source S is spaced from a listener P in an environment which includes a plurality of walls W1, W2, W3. In such an environment the listener will of course perceive sounds from the source S along a direct path DP1. Also, the listener will perceive sounds reflected from the walls of the environment as illustrated in FIG. 2 by the path RP1 to a point P1 on the wall W1 and thence along path RP2 to the listener P. In a stereophonic recording, microphones ML and MR are situated in front of the source S as shown in FIG. 2. If the source S is equidistant from the microphones, then both microphones will pick up sounds from the source S along direct paths DP2 and DP3. In addition, the hall ambience information will be recorded by the left and right microphones ML and MR in addition to the direct sound from the source. This is illustrated by the reflected paths RP3 and RP4 from the point P1 on wall W1.

Turning now to FIG. 3, there is illustrated what happens when the sounds recorded by the microphones as in FIG. 2 are reproduced by loudspeakers LS and RS positioned in the same position relative to the listener P as the recording microphones. In FIG. 3 the listener P is shown as having a left ear Le and a right ear Re. If the sound recorded as in FIG. 2 was initially equidistant from the two microphones, the sound will reach each microphone at the same time. Accordingly, in reproducing the sound, a listener equidistant from the two speakers LS and RS will hear the reproduced direct sound from the left speaker in the left ear (path A) at the same time as the same sound from the right speaker is heard in the right ear (path B). The precedence effect will tend to reduce perception of interaural crosstalk paths a and b. The listener P, hearing the same sound in both ears at once will localize the sound as being directly in front of and between the speakers, as shown in FIG. 4.

Referring again for a moment to FIG. 2, consider a sound reflected from the point P1 on the wall W1 of the hall. The reflected sound from the secondary source reaches the left microphone ML first via the path RP3. This sound is delayed relative to the direct sound along path DP2, partially preserving the distance information about the reflection from P1. The sound from P1 at some time thereafter reaches the right microphone MR along path RP4 after a further delay and further reduction in loudness. In this case, the delay corresponds approximately to the distance MD between the microphones. Turning now to FIG. 5, there is illustrated what the listener P will hear with respect to both the direct and reflected sound illustrated in FIG. 2. When reproduced by the loudspeakers LS and RS the listener will first hear the direct sound from the source at the same time in both ears, corresponding to the apparent source shown in FIG. 5. The listener will then hear the delayed sound corresponding to the reflection from P1 being recorded by the left microphone and reproduced by the left speaker first in the left ear Le and then in the right ear Re. The initial delay caused by the longer path taken by the reflection in reaching the left microphone ML gives the listener an impression of the distance between the original source, P1, and himself. However, the interaural delay $\Delta t$, (corresponding to the time it takes sound to travel between a listener's ears) gives the impression that the reflected sound has come from a point behind and in the same direction as the left speaker, illustrated as the first apparent point P1 in FIG. 5. For reference, the location of the actual point P1 is also shown in FIG. 5. After a further delay, the listener will hear the reflected sound reproduced by the right speaker RS. Since the additional delay (corresponding to the distance MD in FIG. 1) is much greater than any possible interaural delay (except for the case of a very small microphone spacing) this sound will create a second apparent point P1 behind and in the same direction as the right speaker, as illustrated in FIG. 5. However, it has been observed in experiments that the listener mainly perceives the direction information of the first apparent point source P1, largely ignoring the second. Thus the listener perceives the sound as coming primarily from the direction of the left speaker or slightly inside the left speaker if the loudness of the second apparent point source P1 is significant compared to the first. This analysis describes the effect on any other sound sources recorded by the two microphones such that the difference in arrival times at the two microphones is greater than the maximum possible interaural time delay.

Referring to FIG. 6, for some reflected sounds the path lengths to the two microphones ML and MR will be such that the differences in arrival times of the reflected sound at the two microphones will be comparable to a possible value of interaural time delay. Thus, the reflected sound from point P2 to the left microphone ML along path d' would be approximately equal to the path length c' to the right microphone MR plus the interaural time delay $\Delta t$. Thus, assume that d' equals $c'+\Delta t$. When this occurs, the arrival of the reproduced sound from the two speakers at the corresponding ears at slightly different times will have the same effect as an interaural time delay giving the listener a definite impression of the direction and distance of the reflected sound. Referring to FIG. 7, as there illustrated each possible value of interaural time delay corresponds to an angle of incidence for the perceived sound within a 180° arc. As the difference in arrival times at the microphones approaches the maximum possible value of the interaural delay, the apparent direction of the sound would swing rapidly to the right or left. In practice this is limited by the listening angle of the loudspeakers. When the time difference of the sounds arriving at the respective ears approaches the interaural delay corresponding to the listening angle of the speakers, the interaural crosstalk signal of the opposite speaker gradually takes precedence, effectively limiting the apparent sound sources to within the listening angle of the speaker.

It should be apparent at this point that all sound sources, ambient or otherwise, whose signals arrive at the respective microphones with a time difference greater than the interaural time delay corresponding to the listening angle of the reproducing speakers will appear to the listener as apparent sources behind and in the same general direction as one of the speakers as shown in FIG. 5. The delayed signal appearing in the other channel, being lower in loudness, will have only slight effect in drawing the apparent source inside the speakers. This has been confirmed by experiments which show that, in fact, the apparent sound source remains substantially within the listening angle defined by the speakers.

The existence of interaural crosstalk has long been known and discussed at some length in the literature. Additionally, there are several recent patents which have disclosed methods and techniques for enhancing the acoustic image of a stereophonic reproduction system through the manipulation of interaural crosstalk signals, without, however, making a complete analysis of the consequence of these manipulations.

One such prior art patent is U.S. Pat. No. 4,058,675 to Kobayashi et al. This patent discloses a means for cancelling interaural crosstalk by applying inverted and delayed versions of the left and right stereo signals respectively to a second pair of left and right speakers respectively positioned near the left and right main speakers so as to produce the correct geometry. It will be seen later that this method is effective only for certain special cases of the left and right input signals.

Carver discloses in U.S. Pat. No. 4,218,505 an electronic device for cancelling interaural crosstalk. This device inverts one stereo signal, splits it into several components, delays each component separately by a different amount and recombines these with a modified version of the other stereo signal. Performing this operation on both stereo signals, Carver claims to effect a cancellation of interaural crosstalk and to create a "dimensionalized effect."

U.S. Pat. No. 4,199,658 to Iwahara also discloses a technique for performing the interaural crosstalk cancellation for the special case of a binaural signal input. Iwahara uses a second pair of speakers to reproduce the cancellation signal, which is composed of a frequency and phase compensated version of the inverted main signal. This cancellation signal is fed to a speaker just outside the main speaker on the opposite side from which the cancellation signal was derived. The necessary delay is accomplished acoustically by the placement of the sub-speakers and detailed consideration is given to the phase and frequency compensation required to accomplish the cancellation. As previously mentioned, a binaural signal input is specified.

The methods or techniques disclosed in the prior art involve to a certain extent the cancellation of interaural crosstalk. It should be examined in detail what effect each of these would have on the listener's perception of the reproduced sound.

U.S. Pat. No. 4,058,675 to Kobayashi proposes a method for cancelling interaural crosstalk. This method will be discussed in reference to FIG. 8 labelled "Prior Art", and corresponding to FIG. 5 of U.S. Pat. No. 4,058,675.

It can be seen that there is a left speaker system consisting of a main speaker left, MSL, and a sub-speaker left, SSL. There is also a right speaker system consisting of a main speaker right, MSR and a sub-speaker right SSR. The left and right main speakers respectively receive the left and right stereo signals. The sub-speaker left is fed by the left stereo signal after passing through an attenuator, a delay, and a phaseshift. The attenuation, delay and phaseshift are selected such that the signal from the SSL will arrive at the left ear, El, simultaneously and out-of-phase with the signal from the right main speaker, MSR. If the left and right stereo signals are equal the signals from the SSL and MSR will effectively cancel at the left ear, El. Conversely the same will occur for the sub-speaker right, SSR, and the main speaker left, MSR, at the right ear, Er. Thus only when the left and right stereo signals are equal will the crosstalk paths be cancelled.

Assuming that a method or technique is successful in cancelling the interaural crosstalk, it should be examined what effect this would have on the listener's perception of the reproduced sound. Referring to FIG. 3, if the interaural crosstalk cancellation were successful, paths a and b to the opposite ears would be eliminated. This would help the localization of sources equidistant from the recording microphones (FIGS. 1 and 3). As the sources moved off center, however, the difference in arrival times at the two microphones increases corresponding to larger values of interaural time delay and hence greater angles of incidence as illustrated in FIG. 7. Since the crosstalk paths from the speakers have been cancelled out, the speakers give no directional information about themselves. The perceived direction of the apparent sound source will depend only on the difference in arrival times of the signal at the two recording microphones and to a much lesser degree the relative loudness. FIG. 9, for example, shows an off axis source whose signal arrives at the right microphone Δt later than at the left microphone. In this example Δt is equal to the maximum possible interaural time delay. When reproduced, with crosstalk cancelled, the right channel signal will arrive at the right ear Δt later than the left signal at the left ear. FIG. 10 shows the apparent source displaced far to the left of the listener, which it would appear to the listener in such a circumstance.

It should be clear that for microphones spaced far apart only a small displacement off the equidistant axis will be required to create an arrival time difference at the microphone equal to the maximum possible interaural time delay. This will result in a rather dramatic expansion of the center of the stereo stage. For sound sources further displaced and corresponding to time delays greater than the maximum possible interaural time delay, which will include most of the ambience information, the listener will have difficulty localizing the apparent source. In effect, the listener will perceive sounds as if he had ears placed at the recording microphone spacing and may perceive apparent sound sources within his own head when the microphone spacing is large. An accurate prediction of the effects of this situation is beyond the current state of the art of psychoacoustics and beyond the scope of this discussion. It is apparently because of this potential difficulty that the U.S. Pat. No. 4,199,658 to Iwahara specifies a binaural signal input. That is to say, that the recording has been made with a microphone spacing equal to the ear spacing. However, recordings made in this manner are extremely rare. U.S. Pat. No. 4,218,505 to Carver, however, describes the effect that might result if crosstalk cancellation was successfully applied to the reproduction of commonly available recordings:

> "The overall effect of this is a rather startling creation of the impression that the sound is 'totally dimensionalized', in that the hearer somehow appears to be 'within the sound' or in some manner surrounded by the various sources of the sound." (U.S. Pat. No. 4,218,585, column 9, lines 35–39).

Although this effect that Carver describes may be an interesting aural effect, it is not believed to give a realistic impression of the original performance, particularly in the reproduction of ambient information which constitutes the majority of far-off axis signals.

In addition the methods referenced above fail to adequately consider the consequences of large scale cancellation of acoustic energy at low frequencies. Cancellation of acoustic energy occurs whenever the acoustic signals from two or more sources interfere destructively. This interference creates a complicated pattern of nodes and antinodes spaced corresponding to the wavelength. When the spacing between nodes is small, less than one foot, the interference is normally not noticeable when listening to music. When the spacing is several feet or more the interference can be noticeable to a listener as a change in frequency balance of the sound as the listener moves from an area of constructive interference (antinode), to an area of destructive interference, (node). A pair of speakers operating with the same signal, in phase would produce constructive interference, (antinode) at the normal listening positions equidistant from the two speakers. If the phase of one speaker is reversed the antinode at the listening position would become a node (cancellation). The extent of the node would be comparable to the wavelengths involved. It is well known that low frequency sounds are mostly perceived through the conversion of acoustical energy to mechanical or vibrational energy which is felt rather than heard by the listener. Thus a listener positioned at such a node would perceive a considerable reduction of lower frequencies. At the lowest audio frequencies where wavelengths are comparable or larger than room dimensions the extent and magnitude of the reduction would be greatest.

The apparatus and technique disclosed in U.S. Pat. No. 4,199,658 to Iwahara, for example, would suffer from this problem. Although the apparatus would create the desired sound pressure at each of the two ear locations, the presence of the inverted versions of both the left and right signals would cause a substantial cancellation of low frequency energy throughout the listening area. The effect could be compared to that of listening to headphones where although the listener "hears" low frequency sounds there is very little low frequency energy to 'feel'. As a result the sound has no physical impact and lacks realism.

SUMMARY OF THE INVENTION

The present invention has at least two aspects. In accordance with one aspect, it is an object of this invention to provide an apparatus and method for the reproduction of an intentionally exaggerated expansion of the acoustic image in a stereophonic reproduction system, regardless of the nature of the recorded material and by using purely acoustic means.

It is a further object in accordance with one aspect of this invention to achieve this expansion of the acoustic image without a reduction in the perception of low frequency energy.

In accordance with a second aspect, it is an object of this invention to provide an apparatus and method for realistic reproduction of recorded ambience information regardless of the recording microphone placement.

It is a more specific object of the present invention to provide an apparatus and method which is practical and inexpensive for realistic reproduction of recorded ambience information as well as other signals off the central axis, regardless of the recording microphone placement.

In accordance with one embodiment of a first aspect of this invention, in a stereophonic sound reproduction system having a left channel output and a right channel output, a right main speaker and a left main speaker are provided, respectively, at right and left main speaker locations which are equidistantly spaced from a listening location. The listening location is defined as a spatial position for accommodating a listener's head facing the main speakers and having a right ear location and a left ear location along an ear axis, with the right and left ear locations separated along the ear axis by a maximum interaural sound distance of Δt max and the listening location being defined as the point on the ear axis equidistant to the right and left ears. A right sub-speaker and a left sub-speaker are provided at right and left sub-speaker locations which are equidistantly spaced from the listening location. The right and left channel outputs are coupled respectively to the right and left main speakers.

An inverted right channel signal with the low frequency components attenuated is developed and coupled to the left sub-speaker. An inverted left channel signal with the low frequency components attenuated is developed and coupled to the right sub-speaker. By careful selection of the distance between the main speakers and sub-speakers, sound reproduced by the system will have an expanded acoustic image with no reduction of low frequency response as perceived by a listener located at the listening location.

In accordance with one embodiment of a second aspect of this invention, a second left sub-speaker and a second right sub-speaker are added to the apparatus described above. The left and right second sub-speakers are placed at left and right second sub-speaker locations which are equidistantly spaced from the listening location. The left and right channel outputs are coupled respectively to the right and left main speakers and also coupled to the right and left second sub-speakers respectively. An inverted (minus) right channel signal is developed and applied to the first left sub-speaker. An inverted (minus) left channel signal is developed and applied to the first right sub-speaker. By careful selection of the distance between the main speakers and various sub-speakers, sound reproduced by the system as perceived by a listener whose head is located generally at the listening location has a realistic acoustic field and enhanced acoustic image.

Other objects and specific features of the method and apparatus of the present invention will become apparent from the detailed description of the invention in connection with the accompanying drawings.

BRIEF DESCRIPTION OF THE DRAWINGS

FIG. 5 is a diagram illustrating the location of apparent sources to a listener when a stereophonic recording is reproduced, taking into account reflection of sound from the walls of the hall in which the recording was made.

FIG. 6 is a diagram illustrating a situation where path lengths to two recording microphones for reflected sounds is such that the difference in arrival times of the reflected sound of the two microphones is comparable to a possible value of interaural time delay.

FIG. 7 is a diagram showing how each possible value of interaural time delay corresponds to an angle of incidence for perceived sounds within a 180° arc.

FIG. 9 is a diagram illustrating an off-axis source whose signal arrives at the right microphone $\Delta t$ later than at the left microphone, where $\Delta t$ is equal to the maximum possible interaural time delay.

FIG. 12 is similar to FIG. 11 and shows the use of multiple sets of sub-speakers in accordance with one embodiment of the one aspect of the present invention.

FIG. 13 is a diagram showing a second aspect of the invention, in which two sub-speakers are utilized for each channel, with different signals being applied to each of the two sub-speakers.

DESCRIPTION OF THE PREFERRED EMBODIMENTS

Figure 11:
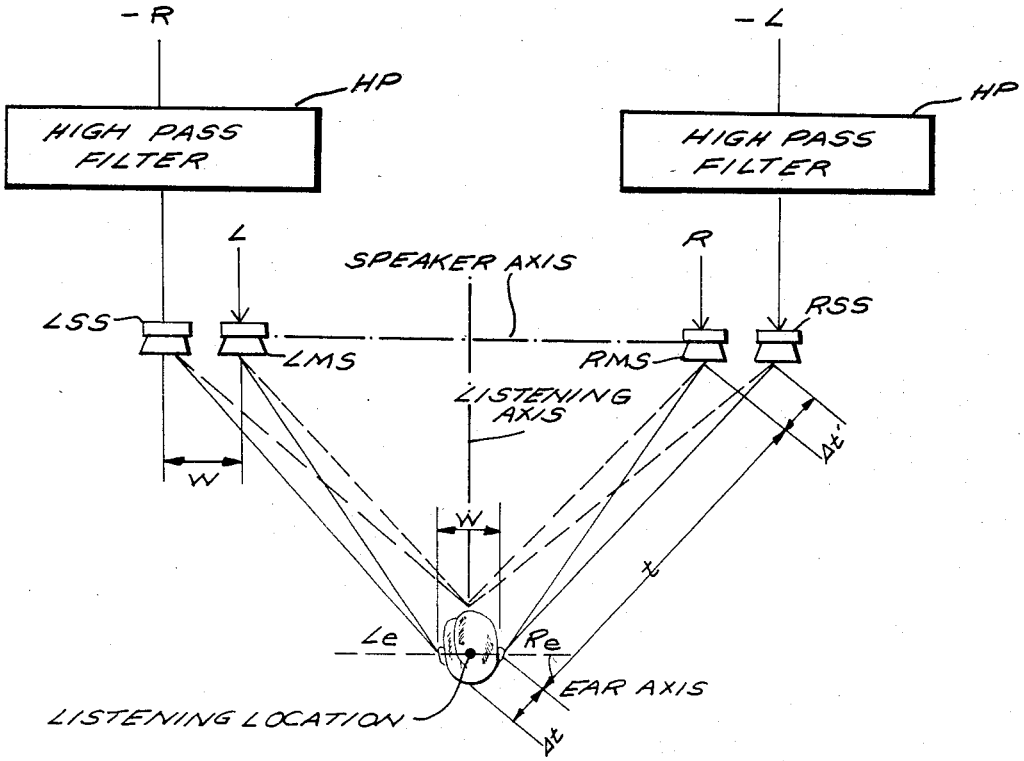
FIG. 11 is a diagram showing the use of main speakers and sub-speakers in accordance with one aspect of the present invention.

Referring now to FIG. 11, there is shown a diagram of one embodiment of a sound reproduction system in accordance with a first aspect of the present invention. A left main speaker LMS and a right main speaker RMS are disposed at left and right main speaker locations along a speaker axis and the left and right main speakers are equidistantly spaced from a listening location. The listening location is defined at the point common to a listening axis perpendicular to the speaker axis and equidistantly spaced from the main speakers, and to the ear axis at a point midway between the left ear Le and right ear Re of a person P.

A left sub-speaker LSS and a right sub-speaker RSS are also provided at left and right sub-speaker locations which, in accordance with this one embodiment, are situated on the speaker axis. The left and right sub-speakers are also equidistantly spaced with respect to the listening location.

As shown in FIG. 11, the right and left main speakers are fed the right and left channel stereo signals, respectively. The sub-speakers, positioned outside the left main speaker and outside the right main speaker are fed the inverted right channel signal through a high pass network, HP, and the inverted left channel signal through a high pass network, HP, respectively. The sub-speakers LSS and RSS are spaced a distance W equal to the ear spacing away from the main speakers. The quantity $\Delta t$ shown in FIG. 11 is the interaural time delay corresponding to the listening angle of the speakers relative to the listener, and $\Delta t'$ is the time delay of the inverted opposite channel from the sub-speakers with respect to the main speakers. With a main speaker to sub-speaker spacing of W, which is equal to the ear spacing, the time delay $\Delta t$ will be equal to the time delay $\Delta t'$.

This geometry is described in U.S. Pat. No. 4,199,658 to Iwahara and assures that for a listener located at the listening position the signal from the left sub-speaker, LSS, will reach the left ear at approximately the same time as the signal from the right main speaker, RMS, reaches the left ear. This is also true for the right sub-speaker and the left main speaker signals at the right ear. Since the signals applied to the subspeakers are inverted versions of the opposite side main speaker signals the left sub-speaker will cancel the right main speaker component reaching the left ear and vice versa for the right ear. However, since the low frequency components of the subspeakers have been attenuated no large scale acoustic cancellation of low frequencies will occur. Thus the system will retain its physical impact and realism at low frequencies. Since directional cues are not perceived at low frequencies the ability to reproduce an enlarged acoustic image will not be impaired.

This apparatus as shown in FIG. 11 will create much the same "dimensionalized effect" that Carver describes in U.S. Pat. No. 4,218,585 through purely acoustic means and with some advantages over Carver. The device described by Carver uses four fixed electrical time delays of various lengths associated with inverted opposite channel signals of various frequency contours all electrically combined with the main signal, from the channel in question, whose frequency response has also been altered. Carver recognizes that an electrical combination of signals for the purpose of crosstalk cancellation and involving a single fixed time delay would produce an all or none situation where the described effect would occur only at a very narrowly determined listening position. By using four signals of various delays he hopes to gain greater flexibility of listener movement but due to the interaction of these signals he is forced to make substantial modifications of the frequency response of the delayed signals as well as the main signal. Although no explanation is presented this may also help to prevent the cancellation of low-frequency acoustic energy.

The invention as shown in FIG. 11 has, as a natural feature of the arrangement of main speakers and sub-speakers, complete flexibility of listener movement along the axis equidistant from the speakers. In addition, because the blending of the signals is done acoustically and the signals produced by transducers whose sizes are comparable to the time delay distances involved, a degree of lateral flexibility of listener position is present in the system. In practice it is observed that the listener may move at least one foot to either side without substantially degrading the effect.

Turning now to FIG. 12, there is shown another embodiment of the first aspect of the present invention, which is similar to the arrangement shown in FIG. 11, except that multiple sets of sub-speakers are utilized. In the specific arrangement shown in FIG. 12 three sub-speakers spaced along the speaker axis are used for each channel, with all three subspeakers coupled through a high-pass filter network to the inverted opposite stereo channel signal. Of course, two sets of sub-speakers or more than three sets could be used. Advantageously, the first sub-speakers are spaced from their respective main speakers by a distance W, corresponding to the inter-ear spacing of a listener P. The spacing of the second sub-speaker from the first sub-speaker, and the third sub-speaker with respect to the second sub-speaker can also be the distance W or somewhat of a smaller distance. The chief advantage of the multiple sub-speaker arrangement of FIG. 12 is that multiple acoustic delays are achieved, offering greater lateral flexibility of listener movement.

As previously discussed, the effect produced on the listener by the complete cancellation of interaural crosstalk may not offer realistic reproduction of the recorded material when the recording microphones are placed at a distance greater than the ear spacing apart. This is due to the complete diminution of the effect of each speaker on the opposite ear, thus leaving a signal appearing in one channel only without a corresponding opposite ear arrival time to cause localization of a source.

Referring now to FIG. 13 there is shown a diagram of one embodiment of a sound reproduction system in accordance with a second aspect of the invention. Two sets of right and left sub-speakers, RSS1, RSS2, LSS1, LSS2 are provided at right and left, first and second sub-speaker locations near the left and right main speakers LMS and RMS. Each left-right pair of sub-speakers is arranged equidistant from the listening position, P and positioned along the speaker axis. As shown in FIG. 13 the right and left main speakers are fed the right and left stereo signals, respectively. The first right and left sub-speakers positioned outside the right and left main speakers are fed inverted versions of the left and right channel stereo signals, respectively. The second right and left sub-speakers also positioned outside the right and left main speakers are fed the in-phase right and left charnel stereo signals, respectively.

In order to facilitate the analysis of the acoustic image created by the arrangement of FIG. 13, consider the left and right signals as functions of time. Specifically, distances will be expressed as sound distances, which correspond to the time it takes sound to travel the distance in question. The geometric center of the transducer will be considered as the source of the sound. As shown in FIG. 13, the time required for sound from the main right speaker RMS to reach the right ear Re is t. The signal at the right ear from this speaker will be designated R (t). The quantity $\Delta t$ is the interaural time delay corresponding to the listening angle of the speakers relative to the listener as shown in FIG. 13. The first sub-speakers RSS1 and LSS1 are spaced from their respective main speakers by a distance W, corresponding to the inter-ear spacing. Accordingly, the time delay separating the sound from a main speaker and its associated sub-speaker is also $\Delta t$. In FIG. 13 $\Delta t'$ is the delay of the respective second sub-speaker signals RSS2 and LSS2 relative to the main signals, e.g. R and L, as determined by the relative placement and orientation of the speakers and listener as shown. Using this notation, the signals arriving at the left and right ears would be:

Left Ear:

$$\begin{aligned}\text{Left} = {} & L(t) - R(t+\Delta t) + L(t+\Delta t') \\ & + R(t+\Delta t) - L(t+\Delta t+\Delta t) + R(t+\Delta t+\Delta t')\end{aligned} \tag{1}$$

$$\begin{aligned}\text{Right} = {} & R(t) - L(t+\Delta t) + R(t+\Delta t') \\ & + L(t+\Delta t) - R(t+\Delta t+\Delta t) + L(t+\Delta t+\Delta t')\end{aligned} \tag{2}$$

Figure 1:
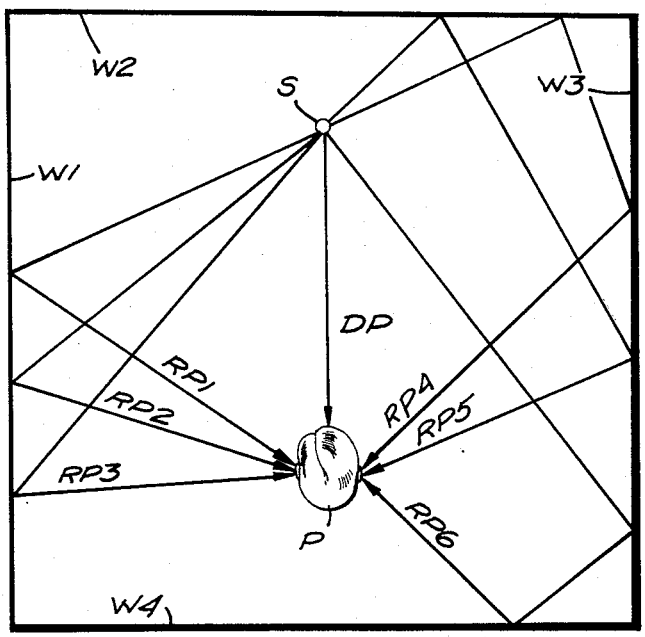
FIG. 1 is a diagram showing the typical multiplicity of paths between a sound source and a listener in a room.
Figure 8:
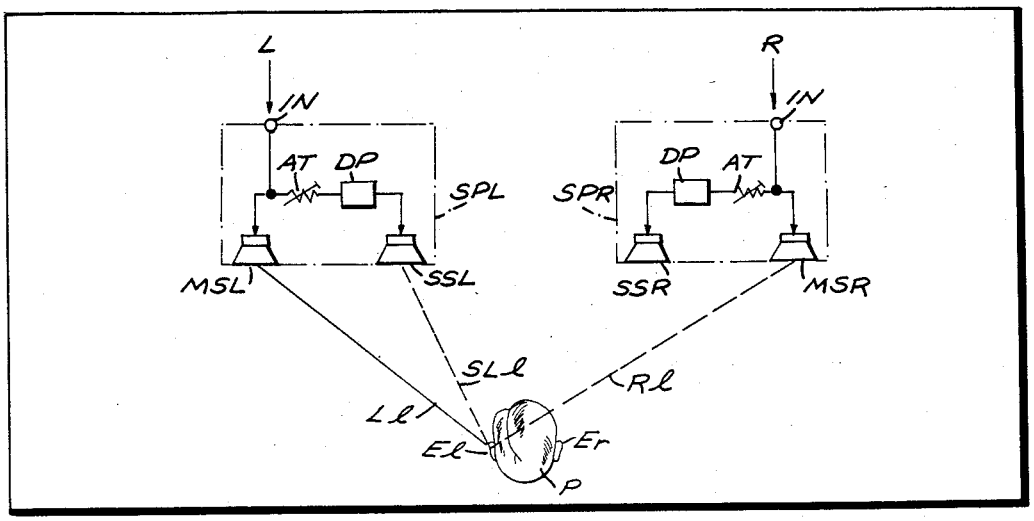
Fig 8 PRIOR ART
FIG. 8 is a reproduction of prior art FIG. 5 of Kobayashi U.S. Pat. No. 4,058,675.
Figure 2:
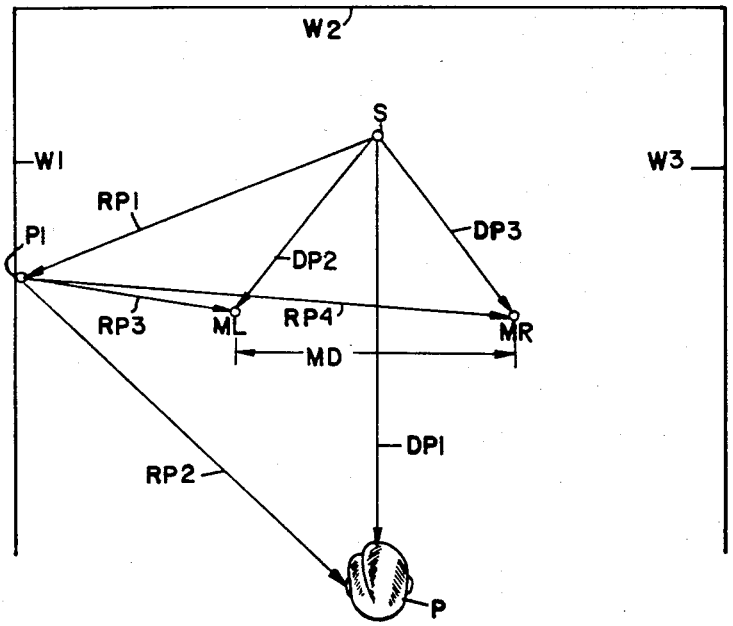
FIG. 2 is a diagram of the typical environment in which stereophonic recordings are made.
Figure 3:
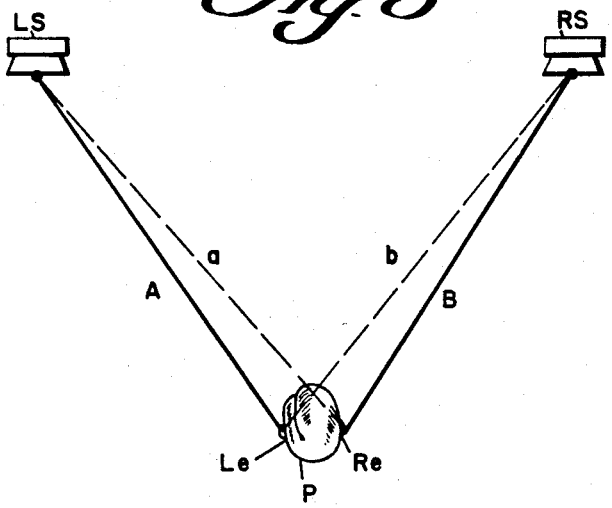
FIG. 3 is a diagram illustrating conventional stereophonic sound reproduction, and showing interaural cross-talk paths.
Figure 4:
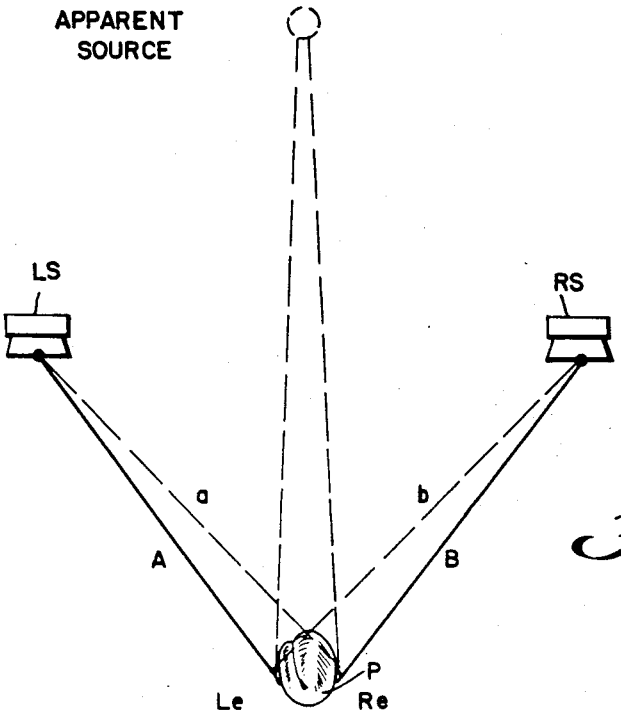
FIG. 4 is a diagram showing the apparent source as perceived by a listener for a sound source equidistant from the recording microphones when the sound is reproduced over a pair of speakers.
Figure 10:
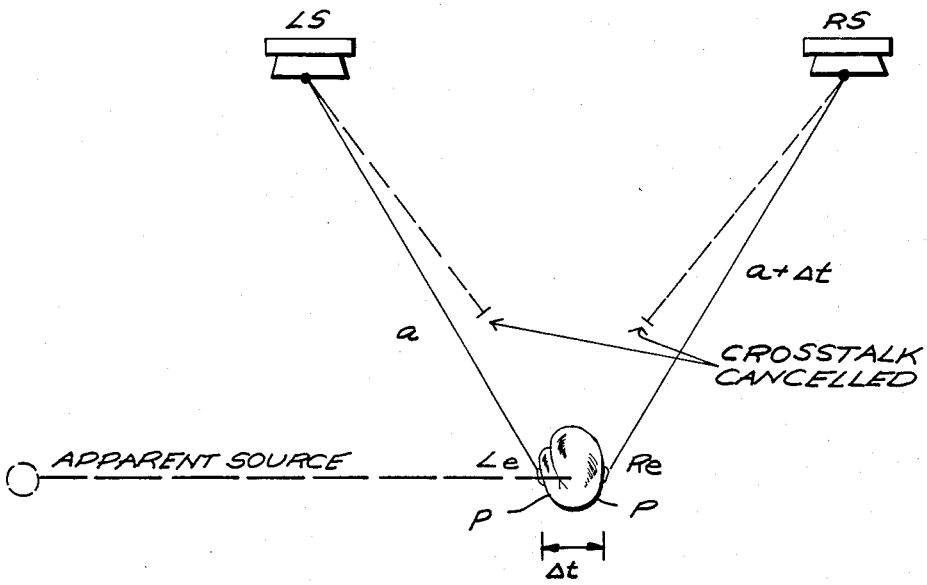
FIG. 10 illustrates the apparent source that would appear to a listener for the situation shown in FIG. 9 when the recording were reproduced on a pair of speakers.

First, consider a source whose sound arrives at both microphones at the same time during recording. Since the left and right channel signals are the same, the signals at each ear will be the same and will arrive at the same time. This is analogous to the situation shown and described with reference to FIG. 4 where the listener, hearing the same signal in both ears at the same time, localizes an apparent sound source directly between the speakers.

As a second case consider a signal appearing only in the left channel. The signals at each ear will reduce to the following:

Left Ear:

$$L(t) + L(t+\Delta t') - L(t+\Delta t+\Delta t) \tag{3}$$

Right Ear:

$$-L(t+\Delta t)+L(t+\Delta t))+L(t+\Delta t+\Delta t') \quad (4)$$

Figure 14:
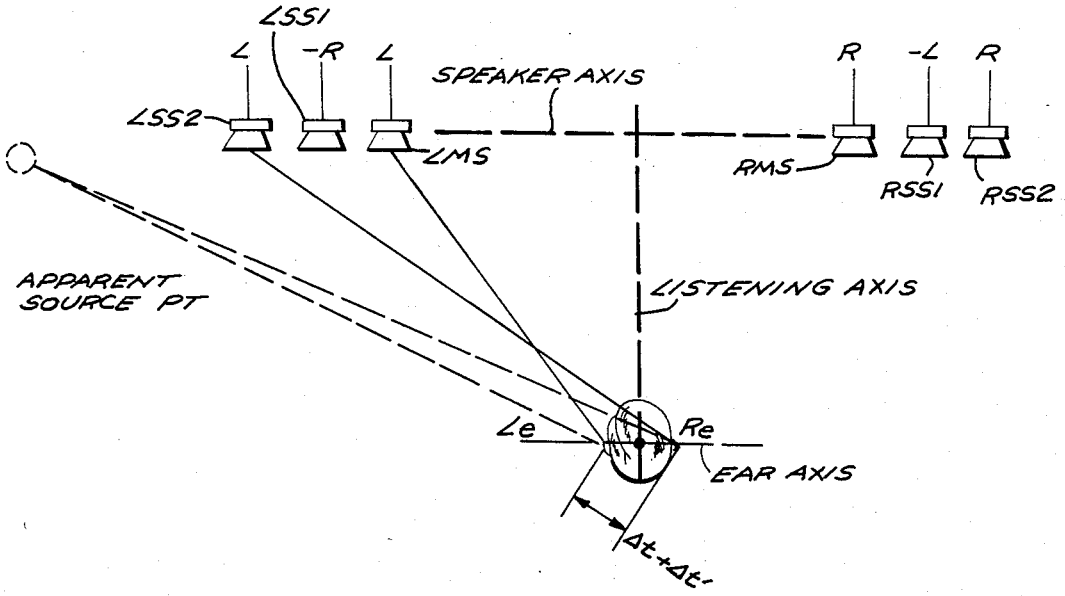
FIG. 14 is a diagram similar to FIG. 13, and showing the apparent source location for a signal appearing only in the left channel.

The right ear terms will cancel leaving only $L(t+\Delta t+\Delta t')$ corresponding to the in-phase left channel signal emanating from the second left sub-speaker, LSS2, and delayed by both the inter-speaker time delay $\Delta t'$ and the interaural time delay $\Delta t$. Due to the precedence effect, the left ear will mainly perceive only the first signal to arrive, L(t). FIG. 14 illustrates the apparent source that a listener would perceive in such a situation. Referring to FIG. 14, hearing the main left signal in the left ear and the same signal delayed by $\Delta t+\Delta t'$ in the right ear, the listener will perceive an apparent sound source with a listening angle outside the speakers corresponding to an interaural delay of $\Delta t+\Delta t'$ as illustrated in FIG. 14. Referring to FIG. 5, ambience information reflected from point P1 on wall W1 would appear first only in the left channel and sometime later (roughly corresponding to the microphone spacing for this specific case) would appear in the right channel. Referring to FIG. 14, the listener would perceive an apparent source as shown in FIG. 14 showing a good correspondence with the correct ambience information. A second apparent source on the right would seem to be indicated at the time that the signal arrives at the right microphone, further away and at a lesser loudness. However, it has been observed in experiments that the listener perceives only the first apparent source. This is probably due to the ability of the auditory system to assign direction to the first and loudest of similar sounds, as discussed previously.

As the recorded source moves more towards the center of the recording microphones, the difference in arrival times at the microphones will become less. This means that the time that a signal will exist only in one or the other channel will become shorter, and the question of the relative loudness of the signal in each channel becomes important in assigning a direction to the apparent source. Consider a case where the same signal appears in both left and right channels but with the left channel twice as loud as the right channel. The respective ears would receive the following signals; after combining like terms:

Left Ear:

$$L(t)+L(t+\Delta t')-L(t+\Delta t+\Delta t)+L/2(t+\Delta t+\Delta t') \quad (5)$$

Right Ear:

$$L/2(t)+L/2(t+\Delta t')-L/2(t+\Delta t+\Delta t)+L(t+\Delta t+\Delta t') \quad (6)$$

In this case the first signals at each ear are the same and arrive at the same time but at half loudness in the right channel. The arrival times would indicate localization of an apparent source between the speakers while the loudness differential would indicate a shift towards the left speaker. However, the first signal arrival is not the loudest arrival on the right channel. The $L(t+\Delta t+\Delta t')$ signal from the second left sub-speaker is double the loudness of any other right ear arrival and hence will not be entirely masked by the precedence effect. This delayed signal would indicate localization well outside the left speaker. It is difficult to predict the net effect of such a complex situation but in practice, it is observed that the listener perceives an apparent source near the left speaker when the ratio of $\Delta t'$ to $\Delta t$ is correctly chosen. As the right channel signal is increased further, the $L(t+\Delta t+\Delta t')$ signal becomes less significant as the first arrivals become more equal. The listener perceives a smooth shift of acoustic image towards the center between the speakers. Conversely, as the right signal is reduced further from the relative half loudness point, the late arrival of the $L(t+\Delta t+\Delta 6')$ signal becomes more significant as a direction cue producing a smooth shift of acoustic image outwards to the perimeter of the 180° stereo field.

In order for a smooth image transition to occur, the inter-speaker delay $\Delta t'$ between the respective main and second sub-speakers along the listening angle between the speakers and the listening location must be greater than the interaural delay $\Delta t$ as shown in FIG. 13 along the listening angle of the listening location with respect to the speaker locations. The interspeaker delay between the main and the respective first sub-speakers along the listening angle between the speakers and the listening location must be approximately equal to the interaural delay $\Delta t$ as shown in FIG. 13 along the listening angle of the listening locations with respect to the speaker locations. When $\Delta t'$ is enough greater than $\Delta t$ the late arrival of the $L(t+\Delta t+\Delta t')$ signal will not be entirely masked by the precedence effect and will contribute correctly to the localization of apparent acoustic images. However, if $\Delta t'$ becomes too much greater than $\Delta t$, the contribution of this signal will be too great, causing the stereo image to expand more rapidly than may be desirable. In experiments, it has been found that considerable variation in the ratio of $\Delta t'$ to $\Delta t$ can be tolerated before unpleasant effects are produced. However, values of this ratio within the optimum range are desirable in order to obtain the best image quality. In practice, but with no intent to limit the invention to such a particular spacing, it has been found that values of $\Delta t'$ from 1.2 to 2 times greater than $\Delta t$ provide a realistic ambient field and acoustic image.

As shown in FIG. 13 in accordance with one specific embodiment of the second aspect of the invention the left and right main and sub-speakers are located at respective main and sub-speaker locations arranged on a speaker axis parallel to an ear axis of a listener in a normal listening position along a listening axis equidistant from the three sets of speakers. It should be understood, however, that any arrangement of main and sub-speakers giving the proper inter-speaker delays $\Delta t$ and $\Delta t'$ will suffice. It should also be understood from the previous discussion that it is critical to the correct functioning of the present invention that the interspeaker delay between the main and respective first sub-speakers closely approximate the interaural delay, $\Delta t$, as shown in FIG. 13 along the listening angle between the speakers and the listening location. However, as previously explained, optimum performance may be obtained for a range of values of $\Delta t'$. Thus there is considerably greater freedom in the placement of the second sub-speakers relative to the main speakers. The arrangement of FIG. 13 where the main speakers and both sets of sub-speakers are located on an axis parallel to the ear axis of a listener does, however, have advantages in allowing greater flexibility in listener position.

It should be understood that it is within the scope of the present invention that signals other than those signals shown in FIG. 13 as applied to the second sub-speakers, RSS2 and LSS2 can be used. As example only, the signals may be reversed thus applying the left stereo signal to RSS2 and the right stereo signal to LSS2. Alternatively a signal composed of L/2+R/2 may be applied to both of the second sub-speakers. However, the specific embodiment as shown in FIG. 13 has been shown to have some advantages in reproducing a realistic acoustic image.

Figure 15:
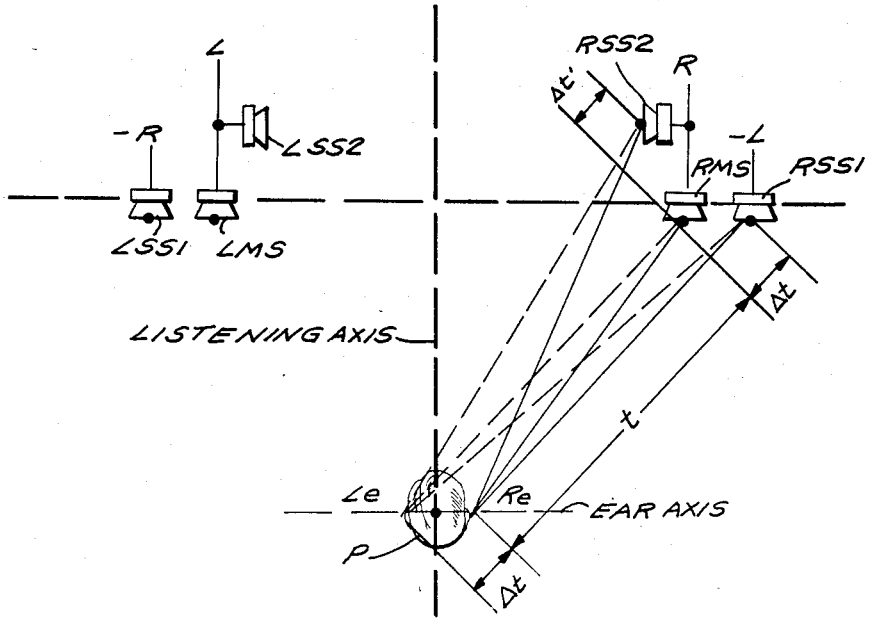
FIG. 15 is a diagram of an alternate embodiment of the second aspect of the invention, in which the second sub-speakers are not on a common axis with the other speakers.

Referring now to FIG. 15, another specific embodiment of the second aspect of the invention is shown to demonstrate the flexibility of placement of the second sub-speakers. In this arrangement the second sub-speakers LSS2 and RSS2 are not positioned on the speaker axis of the main and first sub-speakers, but rather at right angles thereto and inside the main speakers but further from the listener P. However, the relationship of the $\Delta t'$ delay with the interaural delay $\Delta t$ must still be preserved for best results, as discussed previously. The arrangement of FIG. 15 also has an advantage of offering some flexibility in listener position to either side of the listening axis. If desired, the first sub-speakers RSS1 and LSS1 also do not have to be on the same speaker axis as the main speakers. However, the exact listening position is more critical when the first sub-speakers are not on the same axis as the main speakers, or if the first sub-speakers are not parallel to the main speakers.

It is possible that some modifications of the frequency or phase response of the main or sub-speakers may be desirable. One example might be the attenuation of bass response in the sub-speakers. As previously discussed this would be desirable in avoiding large-scale cancellation of low frequency acoustic energy. In addition, it is desirable that the main and sub-speakers be very similar, if not identical, in construction, particularly the main and first sub-speakers. This will assure that differences in acoustic position of dissimilar drive units or differences in phase shift of dissimilar cross-over networks will not occur and hence not degrade the performance of the system.

Additionally, it should be understood that in order to obtain the best performance from the system that there are some limitations on the placement of the speakers relative to the listener. If it is desired to obtain the best performance, the sum of $\Delta t+\Delta t'$ (FIG. 13) should never exceed the maximum possible interaural time delay $\Delta t$ max corresponding to a distance along the ear axis. For an average person, the spacing between the ears is on the order of 6.5 inches, so that the $\Delta t$ max corresponds to the time it takes sound to travel such a distance.

Figure 16:
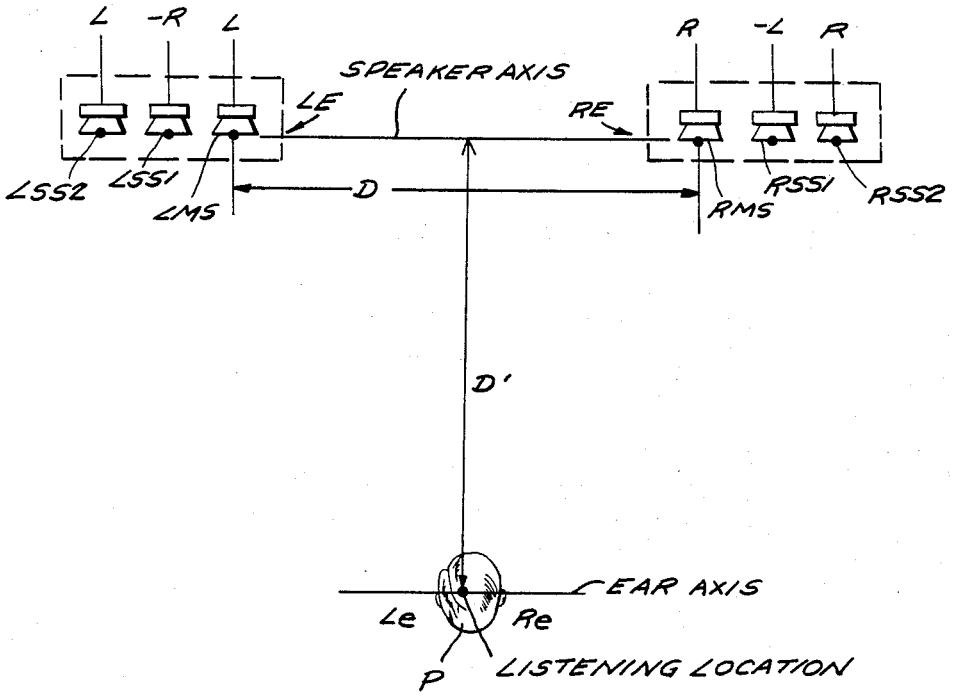
FIG. 16 is a diagram of one embodiment of the invention in which the main speaker and the two sub-speakers for each respective channel are mounted in a common enclosure.

Referring to FIG. 16, the condition that the sum of $\Delta t$ and $\Delta t'$ should not exceed the maximum possible interaural time delay $\Delta t$ max can be met in practice if the distance between the left and right main speakers D along the speaker axis is always less than the perpendicular distance from the listening location along the listening axis D' with respect to the speaker axis. For the arrangement shown in FIG. 16, it has been found that good results are obtained if the spacing D between the main speakers is determined by the following relationship:

$$D=2\times D'/(r+1) \quad (7)$$

where D' is the perpendicular distance to the listening location and r is the ratio of $\Delta t'$ to $\Delta t$. In experiments, it has been observed that as D is made larger than the value predicted by the above relation, the realistic ambient field and enhanced acoustic image that is otherwise obtained begins to disappear.

In accordance with one preferred embodiment of the invention, as illustrated in FIG. 16, the left main speaker and both left sub-speakers may be mounted in a single enclosure LE, and the right main speaker and both right sub-speakers are commonly mounted in a single enclosure RE. This has the advantage of fixing the inter-speaker delays $\Delta t$ and $\Delta t'$ and offers the advantage that only two speaker enclosures are required.

In accordance with a specific embodiment, a spacing between main and first sub-speaker of 6.5 inches and a spacing between main and second sub-speaker of 13 inches, with main and both sub-speakers being identical two-way speaker systems each composed of a 6 inch woofer, a 1 inch dome tweeter and suitable cross-over was found to work well. This combination of inter-speaker spacing gives a ratio $\Delta t'$ to $\Delta t$ of 2 to 1, which was found to be an an acceptable value.

The inverted right and left channel signals which have been referred to throughout this description are easily obtained by reversing the normal connection of the normal right and left channel signals at the input terminals of the appropriate speakers. The high pass networks referred to elsewhere in this description may be constructed very simply according to principles well known to those versed in the art and may be entirely composed of a single capacitor of appropriate value.

As discussed before, the known techniques for cancelling interaural crosstalk, if successful in their stated aim, create an unnatural impression when reproducing sounds far off the equidistant axis of two microphones placed farther apart than the ear spacing, particularly ambient sounds. Also, as previously discussed, those known techniques would be likely to reduce substantially the perception of low frequencies. By requiring that the input signal be recorded binaurally, by two microphones at ear spacing, the Iwahara patent proposes to create a more natural impression, but severely limits the usefulness of the device due to the general unavailability of binaural recordings. In addition, Iwahara fails to address the question of low frequency perception completely. The first aspect of the present invention, by contrast, cancels interaural crosstalk regardless of input signal and creates an intentionally enlarged acoustic image by purely acoustic means, while maintaining full perception of low frequencies. In further contrast, the second aspect of the present invention creates a realistic acoustic image regardless of the position of the recorded source. In addition, this realistic ambient field and acoustic image is created, in accordance with the present invention, with commonly available recorded material, with no requirement for a specially recorded input signal.

As compared to the device described in the prior Carver patent referred to previously, the present invention is a purely acoustic implementation requiring no special electronic components and utilizing the unmodified output from a standard stereophonic high fidelity system. In addition, the present invention recognizes the advantages of certain specific values of delay and sets forth a technique for fixing this value relative to the listener, i.e. incorporating the main and sub-speakers for each channel in a common enclosure, thereby offering increased simplification of set-up and operation to the user. Further, the performance of the present invention is not subject to the inevitable degradation caused by extra stages of electronic signal processing.

The invention described herein is a novel apparatus and method first, for creating an intentionally expanded acoustic image and second, for creating a realistic impression of sounds reproduced from commonly available recorded material. It offers performance advantages over those techniques and apparatus described in the prior art, and is utterly straightforward and simple in its preferred embodiments. Although the invention has been described herein with respect to certain preferred embodiments, it is not intended to limit the invention to any specific details of those preferred embodiments. That is, it should be clear that various modifications and changes can be made to those preferred embodiments without departing from the true spirit and scope of the invention, which is intended to be set forth in the accompanying claims.

I claim:

1. In a stereophonic sound reproduction system having a left channel output and a right channel output, apparatus for reproducing nonbinaural recorded sound having an expanded acoustic image comprising:

a right main speaker and a left main speaker disposed respectively at right and left main speaker locations equidistantly spaced from a listening location, the listening location being a place in space for accommodating a listener's head facing the main speakers and having a right ear location and a left ear location along an ear axis, with the right and left ear locations separated along the ear axis by a maximum interaural sound distance of $\Delta t_{max}$, and the listening location being defined as the point on the ear axis equidistant to the right and left ears, the listening location being spaced from the main speakers and defining a listening angle with respect thereto to result in an interaural time delay $\Delta t$ of the right and left ear locations along the listening angle to the left and right main speakers, at least one right sub-speaker and at least one left sub-speaker disposed respectively at right and left sub-speaker locations equidistantly spaced from the listening location;

the right and left sub-speaker locations being spaced from the respective right and left main speaker locations such that the inter-speaker delay of the right sub-speaker over the right main speaker with respect to the right ear location and the inter-speaker delay of the left sub-speaker over the left main speaker with respect to the left ear location are each approximately the same as the interaural time delay $\Delta t$;

means for coupling the right and left channel outputs, respectively, to said right and left main speakers;

means connected to the right and left channel outputs for developing an inverted right channel signal and an inverted left channel signal;

means for coupling the inverted right channel signal to said at least one left sub-speaker and the inverted left channel signal to said at least one right sub-speaker;

whereby sound reproduced by said apparatus as perceived by a listener whose head is located generally at the listening location has an expanded acoustic image.

2. Apparatus in accordance with claim 1 wherein the respective main speakers and sub-speakers are all located along a speaker axis parallel to the ear axis.

3. Apparatus in accordance with claim 1 or 2 wherein said means for coupling the inverted right channel signal to said at least one left sub-speaker and the inverted left channel signal to said at least one right sub-speaker includes high pass filter means.

4. Apparatus in accordance with claim 3 including a plurality of right sub-speakers and a plurality of left sub-speakers.

5. Apparatus in accordance with claim 2 wherein each sub-speaker is separated from its associated main speaker along the speaker axis by a distance approximately equal to the distance between the right and left ear locations along the ear axis.

6. Apparatus in accordance with claim 5 including a right channel speaker enclosure wherein the right main speaker and right sub-speaker are commonly mounted to fix the spacing therebetween, and including a left channel enclosure wherein the left main speaker and left sub-speaker are commonly mounted to fix the spacing therebetween.

7. In a stereophonic sound reproduction system having a left channel output and a right channel output, apparatus for reproducing sound having an expanded acoustic field and acoustic image comprising:

a right main speaker and a left main speaker disposed respectively at right and left maih speaker locations equidistantly spaced from a listening location, the listening location being a place in space for accommodating a listener's head facing the main speakers and having a right ear location and a left ear location along an ear axis, with the right and left ear locations separated along the ear axis by a maximum interaural sound distance of $\Delta t_{max}$, and the listening location being defined as the point on the ear axis equidistant to the right and left ears, the listening location being spaced from the main speakers and defining a listening angle with respect thereto to result in an interaural time delay $\Delta t$ of the right and left ear locations along the listening angle to the left and right main speakers, a first right sub-speaker and a first left sub-speaker disposed respectively at first right and left sub-speaker locations equidistantly spaced from the listening location;

the first right and left sub-speaker locations being spaced from the respective right and left main speaker locations such that the inter-speaker delay of the first right sub-speaker over the right main speaker with respect to the right ear location and the inter-speaker delay of the first left sub-speaker over the left main speaker with respect to the left ear location are each approximately the same as the interaural time delay $\Delta t$;

a second right sub-speaker and a second left sub-speaker disposed respectively at second right and left sub-speaker locations equidistantly spaced from the listening location;

the second right and left sub-speaker locations being spaced from the respective right and left main speaker locations such that the interspeaker delay of the second right sub-speaker over the right main speaker with respect to the right ear location and the interspeaker delay of the second left sub-speaker over the left main speaker with respect to the left ear location are each $\Delta t'$;

means for coupling the right and left channel outputs, respectively, to said right and left main speakers;

means for connection to the right and left channel outputs for developing an inverted right channel signal and an inverted left channel signal, and means for coupling the inverted right channel signal to said first left sub-speaker and the inverted left channel signal to said first right sub-speaker;

means for coupling to the right and left channel outputs for developing an additional pair of signals therefrom, and for coupling, respectively, each of the pair of signals to said second sub-speakers, respectively;

whereby sound reproduced by said apparatus as perceived by a listener whose head is located generally at the listening location has an expanded acoustic field and acoustic image.

8. Apparatus in accordance with claim 7 wherein said means for developing an additional pair of signals and for coupling, respectively, each of the pair of signals to said second sub-speakers, respectively, comprises means for coupling the left channel output to the second left sub-speaker and the right channel output to the second right sub-speaker.

9. Apparatus in accordance with claim 7 wherein said means for developing an additional pair of signals and for coupling, respectively, each of the pair of signals to said second sub-speakers comprises means for developing a pair of signals, each of which is one half the right channel output plus one half the left channel output, with a respective one of said pair of signals being applied to the respective second right and left sub-speakers.

10. Apparatus in accordance with claim 8 wherein the main speakers are separated along a main speaker axis by a distance D, the listening location is spaced from the speaker axis by a distance D′, and the ratio of $\Delta t'$ to $\Delta t$ is r, and wherein $$D=2\times D'/(r+1).$$

11. Apparatus in accordance with claim 10 wherein both the first and second, right and left sub-speakers are also positioned along the main speaker axis.

12. Apparatus in accordance with claim 8 or 11 including a right channel speaker enclosure wherein said right main speaker and said first and second right sub-speakers are commonly mounted to fix the spacing therebetween, and including a left channel speaker enclosure wherein said left main speaker and said first and second left sub-speakers are commonly mounted to fix the spacing therebetween.

13. A method for reproducing sound from a non-binaural recorded stereophonic source having a left channel output and a right channel output in which the reproduced sound has an expanded acoustic image comprising the steps of:

disposing a right main speaker and a left main speaker at right and left main speaker locations equidistantly spaced from a listening location, the listening location being a place in space for accommodating a listener's head facing the main speakers and having a right ear location and a left ear location along an ear axis, with the right and left ear locations separated along the ear axis by a maximum interaural sound distance of $\Delta t_{max}$, and the listening location being defined as the point on the ear axis equidistant to the right and left ears, the listening location being spaced from the main speakers and defining a listening angle with respect thereto to result in an interaural time delay $\Delta t$ of the right and left ear locations along the listening angle to the left and right main speakers;

disposing at least one right sub-speaker and at least one left sub-speaker at right and left sub-speaker locations equidistantly spaced from the listening location;

selecting the right and left sub-speaker locations such that the inter-speaker delay of the right sub-speaker over the right main speaker with respect to the right ear location and the inter-speaker delay of the left sub-speaker over the left main speaker with respect to the left ear location are each approximately the same as the interaural time delay $\Delta t$;

coupling the right and left channel outputs to the right and left main speakers, respectively;

deriving from the right and left channel outputs an inverted right channel signal and an inverted left channel signal; and coupling the inverted right channel signal to the at least one left sub-speaker and coupling the inverted left channel signal to the at least one right sub-speaker.

14. A method in accordance with claim 13 wherein the main speaker locations and sub-speaker locations are selected to be on a common speaker axis which is parallel to the ear axis.

15. A method in accordance with claim 13 or 14 including the step of high pass filtering the inverted right and left channel signals prior to applying them to the at least one left and at least one right sub-speakers, respectively.

16. A method in accordance with claim 15 including disposing a plurality of right sub-speakers and a plurality of left sub-speakers along the common speaker axis.

17. A method in accordance with claim 15 wherein the right and left sub-speaker locations are selected such that they are separated from their associated main speakers by a distance approximately equal to the distance between the right and left ear locations along the ear axis.

18. A method in accordance with claim 17 including the steps of mounting the right main speaker and the at least one right sub-speaker in a common enclosure to fix the spacing therebetween, and mounting the left main speaker and the at least one left sub-speaker in a common enclosure to fix the spacing therebetween.

19. A method for reproducing sound from a stereophonic source having a left channel output and a right channel output in which the reproduced sound has an expanded acoustic field and acoustic image comprising the steps of:

disposing a right main speaker and a left main speaker at right and left main speaker locations equidistantly spaced from a listening location, the listening location being a place in space for accommodating a listener's head facing the main speakers and having a right ear location and a left ear location along an ear axis, with the right and left ear locations separated along the ear axis by a maximum interaural sound distance of $\Delta t_{max}$, and the listening location being defined as the point on the ear axis equidistant to the right and left ears, the listening location being spaced from the main speakers and defining a listening angle with respect thereto to result in an interaural time delay $\Delta t$ of the right and left ear locations along the listening angle to the left and right main speakers;

disposing a first right sub-speaker and a first left sub-speaker at first right and left sub-speaker locations equidistantly spaced from the listening location;

selecting the first right and left sub-speaker locations such that the inter-speaker delay of the first right sub-speaker over the right main speaker with respect to the right ear location and the inter-speaker delay of the first left sub-speaker over the left main speaker with respect to the left ear location are each approximately the same as the interaural time delay $\Delta t$;

disposing a second right sub-speaker and a second left sub-speaker at second right and left sub-speaker locations equidistantly spaced from the listening location;

selecting the second right and left sub-speaker locations such that the inter-speaker delay of the second right sub-speaker over the right main speaker with respect to the right ear location and the inter-speaker delay of the second left sub-speaker over the left main speaker with respect to the left ear location are each equal to $\Delta t'$;

coupling the right and left channel outputs, respectively, to the right and left main speakers;

developing from the right and left channel outputs an inverted right channel signal and an inverted left channel signal;

coupling the inverted right channel signal to the first left sub-speaker and coupling the inverted left channel signal to the first right sub-speaker;

developing from the right and left channel outputs an additional pair of signals; and coupling the pair of signals, respectively, to the second right and left sub-speakers.

20. A method in accordance with claim 19 wherein the additional pair of signals comprises the left and right channel outputs, and including the step of coupling the left channel output to the second left sub-speaker and the right channel output to the second right sub-speaker.

21. A method in accordance with claim 19 wherein the main speaker locations are selected to be separated along a main speaker axis by a distance D, the listening location is selected to be spaced from the main speaker axis by a distance D', the ratio of $\Delta t'$ to $\Delta t$ is selected to be r, and wherein D, D' and r are selected such that $D=2\times D'A/(r+1)$.

22. A method in accordance with claim 21 wherein the first and second right and left sub-speaker locations are all selected to be on the main speaker axis.

23. A method in accordance with claims 20, 21, or 22, including the step of mounting the right main speaker and first and second right sub-speakers in a common enclosure to fix the respective spacings therebetween, and mounting the left main speaker and first and second left sub-speakers in an additional common enclosure to also fix the respective spacings therebetween.

* * * * *